US011425521B2

(12) United States Patent
Noh et al.

(10) Patent No.: US 11,425,521 B2
(45) Date of Patent: Aug. 23, 2022

(54) COMPENSATING FOR BINAURAL LOUDSPEAKER DIRECTIVITY

(71) Applicant: DTS, Inc., Calabasas, CA (US)

(72) Inventors: Daekyoung Noh, Huntington Beach, CA (US); Oveal Walker, Chatsworth, CA (US)

(73) Assignee: DTS, Inc., Calabasas, CA (US)

( * ) Notice: Subject to any disclaimer, the term of this patent is extended or adjusted under 35 U.S.C. 154(b) by 278 days.

(21) Appl. No.: 16/164,367

(22) Filed: Oct. 18, 2018

(65) Prior Publication Data

US 2020/0128346 A1 Apr. 23, 2020

(51) Int. Cl.
*H04S 3/00* (2006.01)
*H04R 5/02* (2006.01)
(Continued)

(52) U.S. Cl.
CPC ..... *H04S 3/008* (2013.01); *H04R 5/02* (2013.01); *H04R 5/04* (2013.01); *H04S 7/303* (2013.01); *H04S 2400/01* (2013.01)

(58) Field of Classification Search
CPC ..... H04S 3/008; H04S 7/303; H04S 2400/01; H04R 5/02; H04R 5/04
See application file for complete search history.

(56) References Cited

U.S. PATENT DOCUMENTS 5,222,059 A * 6/1993 Holman ..... H04S 7/307 381/20
5,631,964 A * 5/1997 Harada ..... H04S 1/007 381/300
(Continued)

FOREIGN PATENT DOCUMENTS

CN 104219604 A * 12/2014
WO WO-2020081103 A1 4/2020

OTHER PUBLICATIONS

Cecchi et al, An Advanced Spatial Sound Reproduction System with Listener Position tracking (Year: 2014).*
(Continued)

*Primary Examiner* — Matthew A Eason
*Assistant Examiner* — Kuassi A Ganmavo
(74) *Attorney, Agent, or Firm* — Schwegman Lundberg & Woessner, P.A.

(57) ABSTRACT

The directivity of a loudspeaker describes how sound produced by the speaker varies with angle and frequency. Low-frequency sound tends to be relatively omnidirectional, while high-frequency sound tends to be more strongly directional. Because the two ears of a listener are in different spatial positions, the direction-dependent performance of the speakers can produce unwanted differences in volume or spectral content between the two ears. For example, high-frequency sounds may appear to be muffled in one ear, compared to the other. A multi-speaker sound system can employ binaural directivity compensation, which can compensate for directional variations in performance of each speaker, and can reduce or eliminate the difference in volume or spectral content between the left and right ears of a listener. The binaural directivity compensation can optionally be included with spatial audio processing, such as crosstalk cancellation, or can optionally be included with loudspeaker equalization.

18 Claims, 3 Drawing Sheets

(51) Int. Cl.
*H04S 7/00* (2006.01)
*H04R 5/04* (2006.01)

(56) References Cited

U.S. PATENT DOCUMENTS

| | | | | |
|---|---|---|---|---|
| 6,243,476 | B1 * | 6/2001 | Gardner | H04S 3/002 381/1 |
| 6,307,941 | B1 | 10/2001 | Tanner, Jr. et al. | |
| 6,621,909 | B1 * | 9/2003 | Webb | H04R 1/30 181/144 |
| 9,578,440 | B2 | 2/2017 | Otto et al. | |
| 9,838,825 | B2 | 12/2017 | Helwani et al. | |
| 9,949,053 | B2 | 4/2018 | Grosche et al. | |
| 9,973,874 | B2 | 5/2018 | Stein et al. | |
| 10,499,153 | B1 * | 12/2019 | Seidess | H04S 7/307 |
| 2003/0018477 | A1 | 1/2003 | Hinde | |
| 2004/0179693 | A1 * | 9/2004 | Abel | H04S 1/002 381/1 |
| 2005/0063555 | A1 * | 3/2005 | Berardi | H04R 1/403 381/104 |
| 2006/0115090 | A1 * | 6/2006 | Kirkeby | H04R 5/04 381/17 |
| 2008/0025534 | A1 * | 1/2008 | Kuhn | H04S 7/30 381/300 |
| 2008/0123877 | A1 * | 5/2008 | Rivera | H04R 5/02 381/184 |
| 2009/0086682 | A1 * | 4/2009 | Kazmi | H04W 52/146 370/335 |
| 2011/0081032 | A1 * | 4/2011 | Soulodre | H04S 1/002 381/300 |
| 2012/0063616 | A1 * | 3/2012 | Walsh | H03G 9/025 381/103 |
| 2013/0041648 | A1 * | 2/2013 | Osman | H04S 7/304 704/2 |
| 2013/0058505 | A1 * | 3/2013 | Munch | H04R 1/403 381/120 |
| 2013/0163766 | A1 * | 6/2013 | Choueiri | H04S 1/002 381/17 |
| 2014/0064526 | A1 * | 3/2014 | Otto | H04S 5/00 381/300 |
| 2015/0036848 | A1 * | 2/2015 | Donaldson | H04S 7/303 381/303 |
| 2016/0044430 | A1 * | 2/2016 | Mcgrath | H04S 1/005 381/17 |
| 2016/0249151 | A1 | 8/2016 | Grosche et al. | |
| 2016/0353205 | A1 * | 12/2016 | Munch | H04R 3/14 |
| 2017/0070838 | A1 | 3/2017 | Helwani et al. | |
| 2017/0366912 | A1 | 12/2017 | Stein et al. | |
| 2017/0366913 | A1 | 12/2017 | Stein et al. | |
| 2017/0366914 | A1 | 12/2017 | Stein et al. | |
| 2019/0230430 | A1 * | 7/2019 | Hua | H04R 1/323 |
| 2019/0394569 | A1 * | 12/2019 | Moore | H04R 29/005 |

OTHER PUBLICATIONS

"Genelec 8260A 8351A 8250A 8240A Operating Manual", Genelec Document D0081R001c, [Online]. Retrieved from the Internet: <URL: https://www.genelec.com/sites/default/files/media/Studio%20monitors/SAM%20Studio%20 Monitors/8260A/genelec_8240_8250_8351_8260_opman.pdf>, (2016), 24 pgs.

Antila, Marko, et al., "Sound Directivity Control Using Striped Panel Loudspeaker", AES Convention Paper 5306, 110th Convention, (May 2001), 8 pgs.

Hughes, Charles, "Loudspeaker Directivity Improvement Using Low Pass and All Pass Filters", 125th AES Convention, Excelsior Audio Design & Services, (Oct. 2008), 20 pgs.

Linkwitz, Siegfried, "Constant directivity loudspeaker designs", Linkwitz Lab, [Online]. Retrieved from the Internet: <URL: http://linkwitzlab.com/Constant_directivity_louds.htm>, (accessed May 24, 2018), 15 pgs.

Meyer, David G., "Digital Control of Loudspeaker Array Directivity", J. Audio Eng. Soc., vol. 32, No. 10, (Oct. 1984), 747-754.

Romoli, Laura, et al., "A New Approach to Digital Directivity Control of Loudspeakers Line Arrays Using Wavefield Synthesis Theory", Proceeding of the 11th International Workshop on Acoustic Echo and Noise Control, (2008), 4 pgs.

Vollesen, Henrik, et al., "Control of Loudspeaker Directivity by Mechanical Optimization of the Diaphragm", AES 94th Convention 1993, (Mar. 1993), 1-17.

"International Application Serial No. PCT/US2018/064961, International Search Report dated Mar. 25, 2019", 2 pgs.

"International Application Serial No. PCT/US2018/064961, Written Opinion dated Mar. 25, 2019", 8 pgs.

"International Application Serial No. PCT/US2018/064961, International Preliminary Report on Patentability dated Apr. 29, 2021", 10 pgs.

* cited by examiner

COMPENSATING FOR BINAURAL LOUDSPEAKER DIRECTIVITY

FIELD OF THE DISCLOSURE

The present disclosure relates to audio systems and methods.

BACKGROUND OF THE DISCLOSURE

A physical property of a loudspeaker that mathematically describes its direction-dependent performance is known as directivity.

The directivity of a speaker describes how the sound pressure level (e.g., a volume level) varies with respect to propagation angle away from the speaker. The propagation angle can be defined as zero along a central axis of the speaker (e.g., a direction orthogonal to a cabinet of the speaker). The propagation angle can increase away from the central axis in three dimensions, such that the directivity can be typically expressed in a horizontal direction and in a vertical direction. Typically, directivity in a particular direction can be expressed in decibels (dB), formed from a ratio of the volume along the particular direction, divided by a volume along the central axis of the speaker.

The directivity of a speaker varies strongly with frequency. Low-frequency sound tends to propagate from a speaker with relatively little variation with angle. High-frequency sound tends to be more strongly directional.

BRIEF DESCRIPTION OF THE DRAWINGS

Corresponding reference characters indicate corresponding parts throughout the several views. Elements in the drawings are not necessarily drawn to scale. The configurations shown in the drawings are merely examples, and should not be construed as limiting the scope of the invention in any manner.

DETAILED DESCRIPTION

Figure 1:
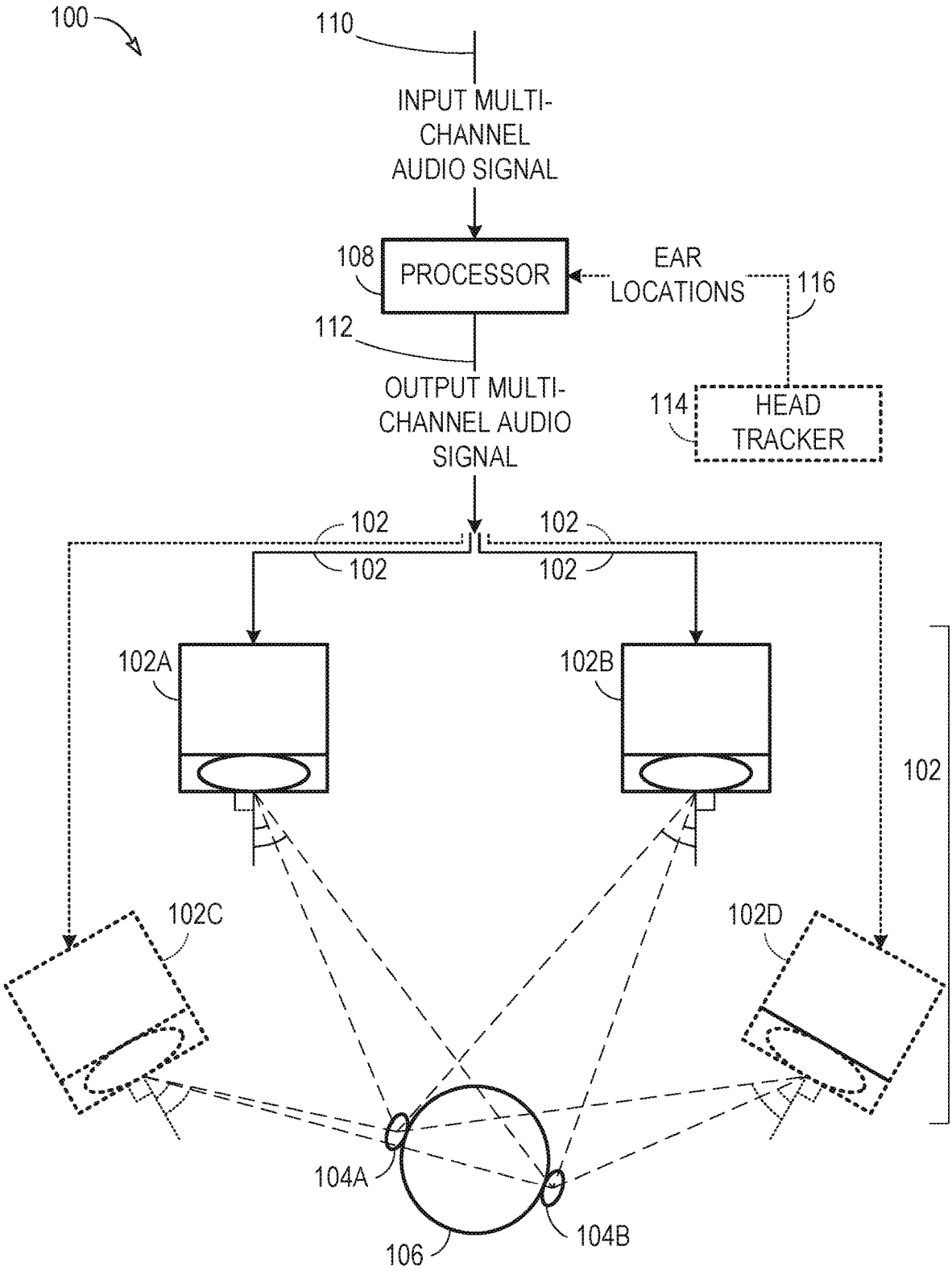
FIG. 1 shows a top view of an example of a system for producing binaural directivity-compensated sound, in accordance with some embodiments.

A multi-speaker sound system can employ binaural directivity compensation to compensate for directional variations in performance of each speaker in the multi-speaker system. The system can embed the binaural directivity compensation within processing that is used to generate the signals sent to the speakers.

To understand binaural directivity compensation, it is instructive to first understand the property of speaker directivity.

Directivity is an inherent property of a speaker. The directivity of a speaker mathematically describes the falloff in sound pressure level, as a function of horizontal (azimuth) and vertical (elevation) angles away from a central axis of the speaker, as a function of frequency, for a range of listening points. The directivity of a speaker is a scalar value, typically expressed in decibels (dB) and often normalized to 0 dB, which varies as a function of frequency, of horizontal angle, and vertical angle.

Because there are three independent variables associated with each value of directivity, there are several ways to display directivity data. In one example, the directivity is plotted as a series of curves, each curve corresponding to a single angle (either horizontal or vertical), with (typically normalized) sound pressure level on a vertical axis and frequency on a horizontal axis. In another example, the directivity is plotted as series of contours of equal loudness curves, with angle on a vertical axis and frequency on a horizontal axis. In still another example, the directivity is plotted as a series of curves on a polar graph, with each curve corresponding to a frequency, the circular coordinates corresponding to angles (horizontal or vertical), and the value of sound pressure level increasing at increasing radii away from the center of the plot.

Speaker designers can typically design individual speakers to meet particular target criteria that involve directivity. For example, a loudspeaker for a home environment can be designed to have a relatively large angular range over which the directivity is relatively flat, so that a listener does not hear a significant variation in volume as the listener moves within the soundstage of the speaker. As another example, for speakers designed to project a sound over a relatively long distance, the speakers can be designed to have a deliberately narrow directivity, to more efficiently concentrate the sound energy into a relatively small listening area.

It is straightforward, but tedious, to measure the directivity of a particular make and model of a speaker. Measuring directivity involves taking individual measurements of sound pressure level at particular angular intervals in the soundstage of the speaker. Once the directivity has been measured, the results can be stored and recalled as needed via a lookup table or other suitable mechanism.

While the property of speaker directivity is well known, and is often addressed at the design phase of a loudspeaker, problems caused by speaker directivity are not well known. Specifically, it is not well known that speaker directivity can cause a volume imbalance or spectral content imbalance between left and right ears of a listener.

For a listener in a binaural environment (e.g., with both ears immersed in a common soundstage), speaker directivity can produce imbalance between a listener's ears. For example, because the listener's left and right ears are positioned at different listening points, the listener's left ear can experience one value of speaker directivity, while the listener's right ear can experience a different value of speaker directivity. To the listener, this can sound like a muffling of high frequencies in one ear but not the other. Artifacts like this can be most noticeable when the listener is relatively close to a speaker, is positioned at a relatively high azimuthal or elevation angle with respect to a central axis of the speaker, and/or is listening to a highly directional speaker.

A non-limiting numerical example follows, for particular left and right ear locations in the soundstage of a particular speaker.

For relatively low (e.g., bass) frequencies, such as 250 Hz, the speaker directivity may vary relatively little with propagation angle. As a result, the sound pressure level at the left ear can be roughly the same as the sound pressure level at the right ear, for relatively low frequencies, such as 250 Hz.

For mid-range frequencies, such as 1000 Hz, the speaker directivity may show more variation than the bass frequencies. As a result, there may be some variation in sound pressure level between the two ear locations. For example, the volume at the left ear from the speaker may be louder than the volume at the right ear by 3 dB, or another suitable value, for mid-range frequencies, such as 1000 Hz.

For relatively high (e.g., treble) frequencies, such as 4000 Hz, the speaker directivity may vary significantly with propagation angle. As a result, there may be some significant variation in sound pressure level between the two ear locations. For example, the volume at the left ear from the speaker may be louder than the volume at the right ear by 9 dB, or another suitable value, for relatively high frequencies, such as 4000 Hz.

For the listener, the variation in speaker directivity between the listener's two ears can produce artifacts, such as the perception that high frequencies appear to be muffled at the listener's right ear, compared to the listener's left ear. The frequency values and volume levels discussed above are but a mere non-limiting numerical example. Other frequency values and volume levels can also be used.

Because previous efforts failed to realize the problem of speaker directivity causing imbalance between a listener's ears, previous efforts have also failed to realize a solution that can compensate for such an imbalance. Such a solution can be achieved by binaural directivity compensation, which is explained in further detail below.

Binaural directivity compensation can operate in a sound system that uses multiple speakers, in which the listener listens in a binaural environment (e.g., without headphones, with both ears immersed in a common soundstage). Binaural directivity compensation can be employed for systems in which existing speakers (e.g., speakers that are not necessarily designed from scratch for a particular application) are mounted in a fixed (e.g., time-invariant) orientation to one another. For example, binaural directivity compensation can be employed for the speakers in a laptop computer, which are typically positioned near left and right edges of the computer housing and are generally not repositionable. Binaural directivity compensation can be employed for other suitable multi-speaker systems, as well. The binaural directivity compensation discussed below is most effective for systems in which a single listener, having left and right ears, listens binaurally to a multi-speaker system.

FIG. 1 shows a top view of an example of a system 100 for producing binaural directivity-compensated sound, in accordance with some embodiments. Non-limiting examples of the system 100 can include stereo Bluetooth speakers, network speakers, laptop device, mobile devices, and others. The configuration of FIG. 1 is but one example of such a system 100; other configurations can also be used.

A plurality of speakers 102 (shown in FIG. 1 as including four speakers 102A-D, but optionally including two or more speakers) can direct sound toward an area or volume. Each speaker 102 can have a characteristic directivity that describes a relative volume level output by the speaker 102, as a function of azimuth angle (e.g., horizontal angle with respect to a central axis that can be perpendicular to a speaker face or a cabinet), elevation angle (e.g., vertical angle with respect to the central axis), and frequency. The directivities of the speakers 102 can operationally produce a volume imbalance or spectral content imbalance between left and right ears 104A-B of a listener 106 of the plurality of speakers 102. In some examples, the plurality of speakers 102 can include only a left speaker 102A and a right speaker 102B, which can typically be positioned to the left and right of the listener 106, such as in a laptop computer.

A processor 108 can be coupled to the plurality of speakers 102. In some examples, the processor 108 can supply digital data to the plurality of speakers 102. In other examples, the processor 108 can supply analog signals, such as time-varying voltages or currents, to the plurality of speakers 102.

The processor 108 can receive an input multi-channel audio signal 110. The input multi-channel audio signal 110 can be in the form of a data stream that includes digital data corresponding to multiple audio channels, multiple data streams that each include digital data corresponding to a single audio channel, multiple analog time-varying voltages or currents that correspond to multiple audio channels, or any combination of digital and/or analog signals that can be used to drive the plurality of speakers 102. In some examples, for which the plurality of speakers 102 includes only a left speaker 102A and a right speaker 102B, the input multi-channel audio signal 110 can include data corresponding to a left input audio signal and a right input audio signal.

The processor 108 can perform processing on the input multi-channel audio signal 110 to form an output multi-channel audio signal 112. The output multi-channel audio signal 112 can also be in the form of any combination of digital and/or analog signals that can be used to drive the plurality of speakers 102. In some examples, for which the plurality of speakers 102 includes only a left speaker 102A and a right speaker 102B, the output multi-channel audio signal 112 can include data corresponding to a left output audio signal and a right output audio signal. The processing (explained in detail below with regard to FIGS. 2-4) can include binaural directivity compensation to compensate for directional variations in performance of each speaker 102 of the plurality of speakers 102.

The processor 108 can direct the output multi-channel audio signal to the plurality of speakers 102. The plurality of speakers 102 can produce sound corresponding to the output multi-channel audio signal 112. In some examples, the binaural directivity compensation can operationally reduce or eliminate the volume imbalance or spectral content imbalance between the left and right ears 104A-B of the listener 106.

The binaural directivity compensation (discussed below) can depend on locations of the left and right ears 1044-B of the listener 106. In some examples, the system 100 can optionally include a head tracker 114 that can actively track the left ear location and the right ear location, and provide the measured left and right ear locations 116 to the processor 108. For example, in a video game environment in which the listener 106 moves around in the soundstage and relies on realistic audio information to play the game, the head tracker 114 can help ensure that the processor 108 has reliable values for the left and right ear locations. In other examples, the processor 108 can use estimated and time-invariant left and right ear locations. For example, a processor 108 in a laptop computer can assume that a listener's head is positioned midway between the left and right laptop speakers 102A-B, roughly orthogonal to the laptop screen, and the listener's left and right ears 104A-B are spaced apart by an average width of a human head. These are but mere examples; other examples can also apply.

In some examples, the processing can further include spatial audio processing, which can also depend on locations of the left and right ears 1044-B of the listener 106. The spatial audio processing can cause the plurality of speakers 102 to deliver sound corresponding to a specified left audio channel to a left ear location that corresponds to a left ear 104A of the listener 106, and cause the plurality of speakers 102 to deliver sound corresponding to a specified right audio channel to a right ear location that corresponds to a right ear 104B of the listener 106. In some examples, the spatial audio processing can include imparting location-specific properties to particular sounds, such as reflections from walls or other objects, or placement of particular sounds at specific locations in the soundstage of the listener 106. Video games can use the spatial audio processing to augment a sense of realism for a player, so that location-specific effects in audio can add realism to action shown in corresponding video. For the special case of the plurality of speakers 102 including just a left speaker 102A and a right speaker 102B, the spatial audio processing can include crosstalk cancellation, which is a special case of more general multi-speaker spatial audio processing.

Figure 2:
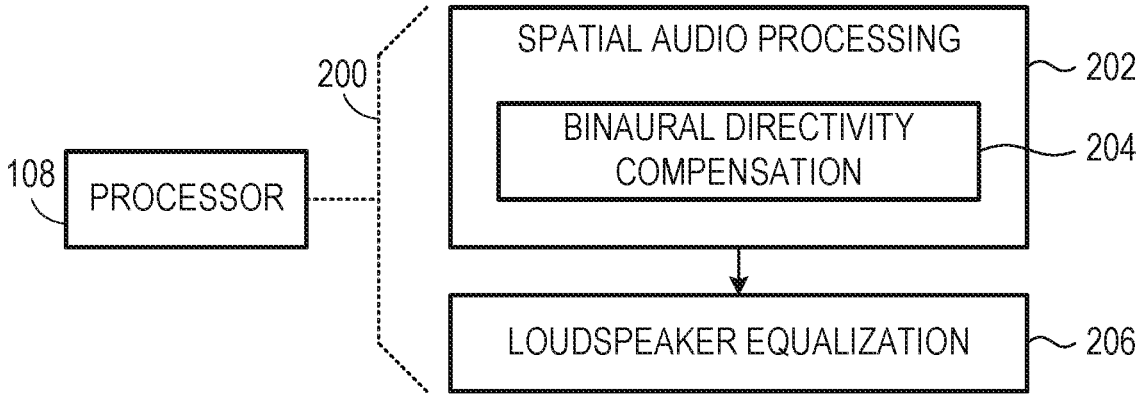
FIG. 2 shows a configuration in which the processor can perform the binaural directivity compensation within the spatial audio processing, in accordance with some embodiments.
Figure 3:
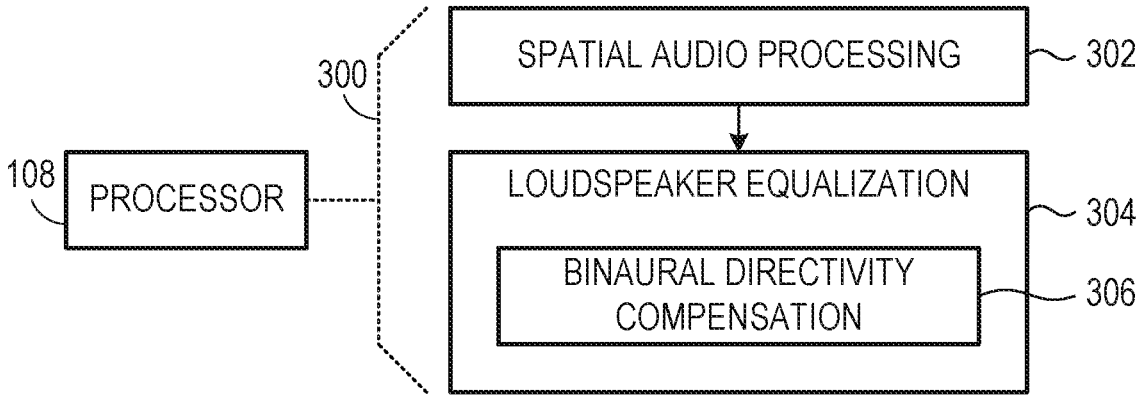
FIG. 3 shows a configuration in which the processor can further perform loudspeaker equalization downstream from the spatial audio processing, and perform the binaural directivity compensation within the loudspeaker equalization, in accordance with some embodiments.
Figure 4:
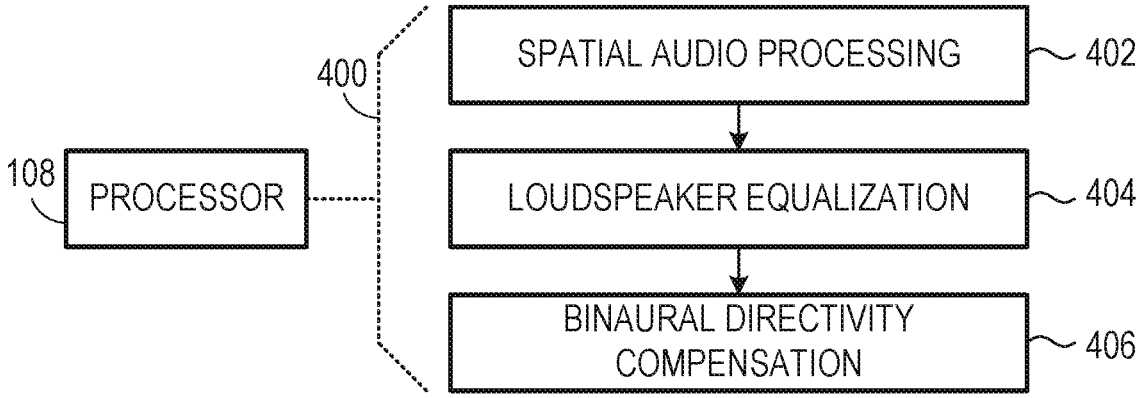
FIG. 4 shows a configuration in which the processor can further perform loudspeaker equalization downstream from the spatial audio processing, and perform the binaural directivity compensation downstream from the loudspeaker equalization, in accordance with some embodiments.

FIGS. 2-4 show three examples of how the processor 108 of FIG. 1 can perform the binaural directivity compensation, in accordance with some embodiments. These are but mere examples; the processor 108 can alternatively use other suitable processes to perform the binaural directivity compensation.

FIG. 2 shows a configuration in which the processor 108 can perform binaural directivity compensation 204 within the spatial audio processing 202, in accordance with some embodiments.

In some examples, such as those in which the plurality of speakers 102 includes only a left speaker 102A and a right speaker 102B, the processor 108 can perform the spatial audio processing 202 to include cancelling crosstalk between the left speaker 102A and the right ear 104B of the listener 106 and between the right speaker 102B and the left ear 104A of the listener 106.

In some examples, the processor 108 can cancel the crosstalk by performing the following operations, which can optionally be performed in any suitable order. First, the processor 108 can provide a first directivity value corresponding to a directivity of the left speaker 102A at the left ear location. Second, the processor 108 can provide a second directivity value corresponding to a directivity of the left speaker 102A at the right ear location. Third, the processor 108 can provide a third directivity value corresponding to a directivity of the right speaker 102B at the left ear location. Fourth, the processor 108 can provide a fourth directivity value corresponding to a directivity of the right speaker 102B at the right ear location. Fifth, the processor 108 can provide a first head-related transfer function that characterizes how the left ear 104A of the listener 106, at the left ear location, receives sound from the left speaker 102A. (Note that head-related transfer functions include effect regarding propagation away from the speaker, including directivity effects, and reception at a listener's ear, including anatomical effects of the ear.) Sixth, the processor 108 can provide a second head-related transfer function that characterizes how the right ear 104B of the listener 106, at the right ear location, receives sound from the left speaker 102A. Seventh, the processor 108 can provide a third head-related transfer function that characterizes how the left ear 104A of the listener 106, at the left ear location, receives sound from the right speaker 102B. Eighth, the processor 108 can provide a fourth head-related transfer function that characterizes how the right ear 104B of the listener 106, at the right ear location, receives sound from the right speaker 102B. Ninth, the processor 108 can form a modified second head-related transfer function as the second head-related transfer function, multiplied by the third directivity value, divided by the fourth directivity value. Tenth, the processor 108 can form in a modified third head-related transfer function as the second head-related transfer function, multiplied by the first directivity value, divided by the second directivity value. Eleventh, the processor 108 can form a compensation matrix as an inverse of a matrix that includes the first, modified second, modified third, and fourth head-related transfer functions. Twelfth, the processor 108 can form an input matrix that includes transforms of the left input audio signal and the right input audio signal. Thirteenth, the processor 108 can form an output matrix calculated as a product of the compensation matrix and the input matrix, the output matrix including transforms of the left output audio signal and the right output audio signal. Once the output audio signals are calculated, the processor 108 can direct the output audio signals to the speakers 102, which produce sound corresponding to the output audio signals. The sound produced by the speakers 102 can include compensation for binaural directivity. Such compensation helps reduce artifacts, such as volume imbalance or spectral imbalance between the ears of the listener, which are caused by the property of speaker directivity.

The Appendix shows an example of the matrix algebra used by the processor 108 to cancel crosstalk and compensate for binaural directivity.

In some examples, the processor 108 can further perform loudspeaker equalization 206 downstream from the spatial audio processing 202 and the binaural directivity compensation 204.

FIGS. 3 and 4 show two configurations in which the processor 108 can perform the binaural directivity compensation downstream from the spatial audio processing, in accordance with some embodiments. In FIG. 3, the processor 108 can further perform loudspeaker equalization 304 downstream from spatial audio processing 302, and perform binaural directivity compensation 306 within the loudspeaker equalization 304. In FIG. 4, the processor 108 can further perform loudspeaker equalization 404 downstream from spatial audio processing 402, and perform binaural directivity compensation 406 downstream from the loudspeaker equalization. The configurations of FIGS. 3 and 4 are but mere examples; other configurations can also be used.

In some examples, for which the processor 108 can perform the binaural directivity compensation 306, 406 downstream from the spatial audio processing 302, 402, and for which the plurality of speakers 102 includes only a left speaker 102A and a right speaker 102B, the processor 108 can perform the spatial audio processing 302, 402 to include cancelling crosstalk between the left speaker 102A and the right ear 104B of the listener 106 and between the right speaker 102B and the left ear 104A of the listener 106.

In some of these examples, for which the processor 108 can perform the binaural directivity compensation 306, 406 downstream from the spatial audio processing 302, 402, and for which the plurality of speakers 102 includes only a left speaker 102A and a right speaker 102B, the processor 108 can cancel the crosstalk by performing the following operations, which can optionally be performed in any suitable order. First, the processor 108 can provide a first head-related transfer function that characterizes how the left ear 104A of the listener 106, at the left ear location, receives sound from the left speaker 102A. Second, the processor 108 can provide a second head-related transfer function that characterizes how the right ear 104B of the listener 106, at the right ear location, receives sound from the left speaker 102A. Third, the processor 108 can provide a third head-related transfer function that characterizes how the left ear 104A of the listener 106, at the left ear location, receives sound from the right speaker 102B. Fourth, the processor 108 can provide a fourth head-related transfer function that characterizes how the right ear 104B of the listener 106, at the right ear location, receives sound from the right speaker 102B. Fifth, the processor 108 can form a compensation matrix as an inverse of a matrix that includes the first, second, third, and fourth head-related transfer functions. Sixth, the processor 108 can form an input matrix that includes transforms of the left input audio signal and the right input audio signal. Seventh, the processor 108 can form an output matrix calculated as a product of the compensation matrix and the input matrix, the output matrix including transforms of the left output audio signal and the right output audio signal. Once the output audio signals are calculated, the processor 108 can direct the output audio signals to the speakers 102, which produce sound corresponding to the output audio signals. The sound produced by the speakers 102 can include compensation for binaural directivity. Such compensation helps reduce artifacts, such as volume imbalance or spectral imbalance between the ears of the listener, which are caused by the property of speaker directivity.

Figure 5:
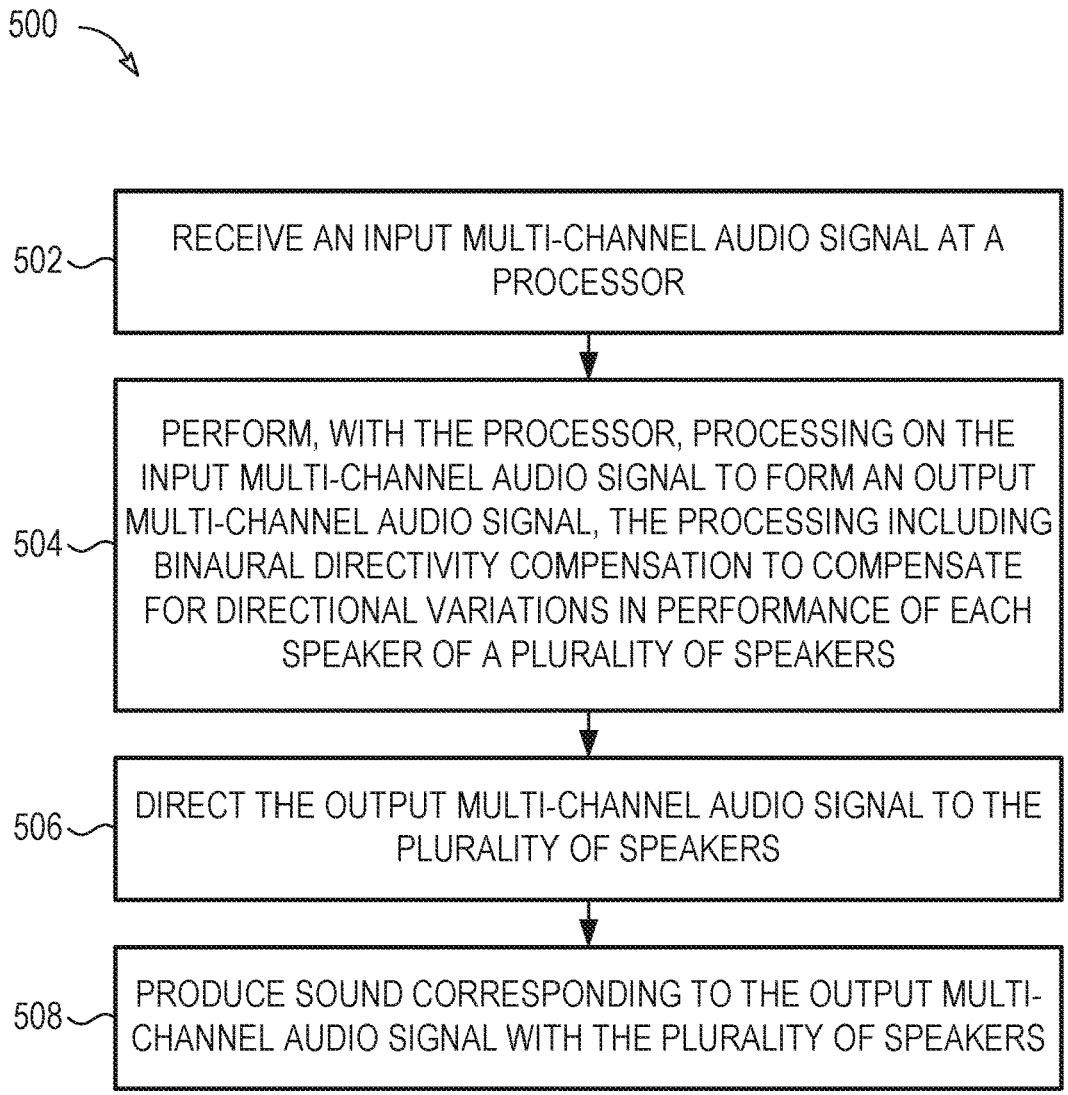
FIG. 5 shows a flowchart of an example of a method for producing binaural directivity-compensated sound, in accordance with some embodiments.

FIG. 5 shows a flowchart of an example of a method 500 for producing binaural directivity-compensated sound, in accordance with some embodiments. The method 500 can be executed by the system 100 of FIG. 1, or by any other suitable multi-speaker system. The method 500 is but one method for producing binaural directivity-compensated sound; other suitable methods can also be used.

At operation 502, a processor of the system can receive an input multi-channel audio signal.

At operation 504, the processor of the system can perform processing on the input multi-channel audio signal to form an output multi-channel audio signal. The processing can include binaural directivity compensation to compensate for directional variations in performance of each speaker of a plurality of speakers.

At operation 506, the processor of the system can direct the output multi-channel audio signal to the plurality of speakers.

At operation 508, the system can produce sound corresponding to the output multi-channel audio signal with the plurality of speakers.

In some examples, each of the plurality of speakers can have a characteristic directivity that describes a relative volume level output by the speaker, as a function of azimuth angle, elevation angle, and frequency. In some examples, the directivities of the speakers can operationally produce a volume imbalance or spectral content imbalance between left and right ears of a listener of the plurality of speakers. In some examples, the binaural directivity compensation can operationally reduce or eliminate the volume imbalance or spectral content imbalance between the left and right ears of the listener.

In some examples, at operation 504, the processing can further include spatial audio processing that can cause the plurality of speakers to deliver sound corresponding to a specified left audio channel to a left ear location that corresponds to a left ear of the listener, and can cause the plurality of speakers to deliver sound corresponding to a specified right audio channel to a right ear location that corresponds to a right ear of the listener.

Other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform in the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can typically be found in devices having at least some minimum computational capability, including, but not limited to, personal computers, server computers, hand-held computing devices, laptop or mobile computers, communications devices such as cell phones and PDAs, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other microcontroller, or can be conventional central processing units (CPUs) having one or more processing cores, including specialized graphics processing unit (GPU)-based cores in a multi-core CPU.

The process actions of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Blu-ray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CDROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or longlived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the encoding and decoding system and method described herein, or portions thereof, may be stored, received, transmitted, or read from any desired combination of computer or machine-readable/media or storage devices and communication media in the form of computer executable instructions or other data structures.

Embodiments of the system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

APPENDIX

There are three general procedures that can be used to equalize the loudspeaker directivity binaurally. First, one can measure the directivity of the loudspeaker. Second, one can create transfer functions of the directivity to each ear. Third, one can form the compensation matrix T as follows:

$$T = \frac{1}{D}\begin{bmatrix} T_i & -T_c \\ -T_c & T_i \end{bmatrix}$$

Quantity $T_i$ is an ipsilateral transfer function, which characterizes how the left ear of the listener, at the left ear location, receives sound from the left speaker, and, because of symmetry, also characterizes how the right ear of the listener, at the right ear location, receives sound from the right speaker.

Quantity $T_c$ is a contralateral transfer function, which characterizes how the left ear of the listener, at the left ear location, receives sound from the right speaker, and, because of symmetry, also characterizes how the right ear of the listener, at the right ear location, receives sound from the left speaker.

Quantity D is set equal to quantity $(T_i^2-T_c^2)$.

In the case where the stereo playback system uses two speakers, but not in a symmetric arrangement with respect to the listener, one can account for the asymmetry by modifying the head-related transfer functions. The head-related transfer function includes an interaural time difference and an interaural intensity difference, over a range of audible frequencies. To account for the asymmetric arrangement of the speakers, one can split the (asymmetric) head-related transfer functions into a pure head-related transfer function and an interaural intensity difference caused by the speaker directivity.

If the system already contains premeasured/synthesized head-related transfer functions, one can embed the binaural directivity difference by multiplying the magnitude ratio from the directivity to the contralateral head-related transfer function, as follows:

$$\text{Quantity } C = \begin{bmatrix} H_{i_L} & H'_{c_R} \\ H'_{c_L} & H_{i_R} \end{bmatrix}^{-1}$$

$$\text{Quantity } H'_{c_L} = \left(\frac{T_{c_L}}{T_{i_L}}\right)H_{c_L}$$

$$\text{Quantity } H'_{c_R} = \left(\frac{T_{c_R}}{T_{i_R}}\right)H_{c_R}$$

Quantity $T_{i_L}$, is a measured or calculated value of the directivity of the left speaker to the left ear.

Quantity $T_{c_L}$ is a measured or calculated value of the directivity of the left speaker to the right ear.

Quantity $T_{i_R}$ is a measured or calculated value of the directivity of the fight speaker to the right ear.

Quantity $T_{c_R}$ is a measured or calculated value of the directivity of the right speaker to the left ear.

There are advantages to incorporating the directivity values in this manner. For example, overall system design can be much simpler than redesigning spatial processing each time by measuring head-related transfer functions for new devices. If head-related transfer function data is based on measured data of multiple subjects or a certain individual, it can be tedious to redo the head-related transfer function measurements for a new configuration of existing elements. In addition, one can easily modify synthesized head-related transfer function data by updating contralateral head-related transfer function values, by including the binaural directivity differences. In addition, overall computation cost can be reduced by merging the binaural directivity compensation into spatial processing or device equalization.

EXAMPLES

To further illustrate the device and related method disclosed herein, a non-limiting list of examples is provided below. Each of the following non-limiting examples can stand on its own, or can be combined in any permutation or combination with any one or more of the other examples.

In Example 1, a system for producing binaural directivity-compensated sound can include: a plurality of speakers; a processor coupled to the plurality of speakers, the processor configured to: receive an input multi-channel audio signal; perform processing on the input multi-channel audio signal to form an output multi-channel audio signal, the processing including binaural directivity compensation to compensate for directional variations in performance of each speaker of the plurality of speakers; and direct the output multi-channel audio signal to the plurality of speakers; wherein the plurality of speakers are configured to produce sound corresponding to the output multi-channel audio signal.

In Example 2, the system of Example 1 can optionally be further configured such that each of the plurality of speakers has a characteristic directivity that describes a relative volume level output by the speaker, as a function of azimuth angle, elevation angle, and frequency; the directivities of the speakers operationally produce a volume imbalance or spectral content imbalance between left and right ears of a listener of the plurality of speakers; and the binaural directivity compensation is configured to operationally reduce or eliminate the volume imbalance or spectral content imbalance between the left and right ears of the listener.

In Example 3, the system of any one of Examples 1-2 can optionally be further configured such that the processing further includes spatial audio processing that: causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener.

In Example 4, the system of any one of Examples 1-3 can optionally further include a head tracker configured to actively track the left ear location and the right ear location.

In Example 5, the system of any one of Examples 1-4 can optionally be further configured such that the processor is configured to use estimated and time-invariant left and right ear locations.

In Example 6, the system of any one of Examples 1-5 can optionally be further configured such that the plurality of speakers includes only a left speaker and a right speaker; the input multi-channel audio signal includes data corresponding to a left input audio signal and a right input audio signal;

and the output multi-channel audio signal includes data corresponding to a left output audio signal and a right output audio signal.

In Example 7, the system of any one of Examples 1-6 can optionally be further configured such that the processor is configured to perform the binaural directivity compensation within the spatial audio processing.

In Example 8, the system of any one of Examples 1-7 can optionally be further configured such that the processor is configured to perform the spatial audio processing to include cancelling crosstalk between the left speaker and the right ear of the listener and between the right speaker and the left ear of the listener.

In Example 9, the system of any one of Examples 1-8 can optionally be further configured such that the processor is configured to cancel the crosstalk by: providing a first directivity value corresponding to a directivity of the left speaker at the left ear location; providing a second directivity value corresponding to a directivity of the left speaker at the right ear location; providing a third directivity value corresponding to a directivity of the right speaker at the left ear location; providing a fourth directivity value corresponding to a directivity of the right speaker at the right ear location; providing a first head-related transfer function that characterizes how the left ear of the listener, at the left ear location, receives sound from the left speaker; providing a second head-related transfer function that characterizes how the tight ear of the listener, at the right ear location, receives sound from the left speaker; providing a third head-related transfer function that characterizes how the left ear of the listener, at the left ear location, receives sound from the right speaker; providing a fourth head-related transfer function that characterizes how the right ear of the listener, at the right ear location, receives sound from the right speaker; forming a modified second head-related transfer function as the second head-related transfer function, multiplied by the third directivity value, divided by the fourth directivity value; forming a modified third head-related transfer function as the second head-related transfer function, multiplied by the first directivity value, divided by the second directivity value; forming a compensation matrix as an inverse of a matrix that includes the first, modified second, modified third, and fourth head-related transfer functions; forming an input matrix that includes transforms of the left input audio signal and the right input audio signal; and forming an output matrix calculated as a product of the compensation matrix and the input matrix, the output matrix including transforms of the left output audio signal and the right output audio signal.

In Example 10, the system of any one of Examples 1-9 can optionally be further configured such that the processor is configured to further perform loudspeaker equalization downstream from the spatial audio processing and the binaural directivity compensation.

In Example 11, the system of any one of Examples 1-10 can optionally be further configured such that the processor is configured to perform the binaural directivity compensation downstream from the spatial audio processing.

In Example 12, the system of any one of Examples 1-11 can optionally be further configured such that processor is configured to perform the spatial audio processing to include cancelling crosstalk between the left speaker and the right ear of the listener and between the right speaker and the left ear of the listener.

In Example 13, the system of any one of Examples 1-12 can optionally be further configured such that the processor is configured to cancel the crosstalk by: providing a first head-related transfer function that characterizes how the left ear of the listener, at the left ear location, receives sound from the left speaker; providing a second head-related transfer function that characterizes how the right ear of the listener, at the right ear location, receives sound from the left speaker; providing a third head-related transfer function that characterizes how the left ear of the listener, at the left ear location, receives sound from the right speaker; providing a fourth head-related transfer function that characterizes how the right ear of the listener, at the right ear location, receives sound from the right speaker; forming a compensation matrix as an inverse of a matrix that includes the first, second, third, and fourth head-related transfer functions; forming an input matrix that includes transforms of the left input audio signal and the right input audio signal; and forming an output matrix calculated as a product of the compensation matrix and the input matrix, the output matrix including transforms of the left output audio signal and the right output audio signal.

In Example 14, the system of any one of Examples 1-13 can optionally be further configured such that the processor is configured to further perform loudspeaker equalization downstream from the spatial audio processing, and perform the binaural directivity compensation within the loudspeaker equalization.

In Example 15, a method for producing binaural directivity-compensated sound can include: receiving an input multi-channel audio signal at a processor; performing, with the processor, processing on the input multi-channel audio signal to form an output multi-channel audio signal, the processing including binaural directivity compensation to compensate for directional variations in performance of each speaker of a plurality of speakers; directing the output multi-channel audio signal to the plurality of speakers; and producing sound corresponding to the output multi-channel audio signal with the plurality of speakers.

In Example 16, the method of Example 15 can optionally be further configured such that each of the plurality of speakers has a characteristic directivity that describes a relative volume level output by the speaker, as a function of azimuth angle, elevation angle, and frequency; the directivities of the speakers operationally produce a volume imbalance or spectral content imbalance between left and right ears of a listener of the plurality of speakers; and the binaural directivity compensation is configured to operationally reduce or eliminate the volume imbalance or spectral content imbalance between the left and right ears of the listener.

In Example 17, the method of any one of Examples 15-16 can optionally be further configured such that processing further includes spatial audio processing that: causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener.

In Example 18, a system for producing binaural directivity-compensated sound can include: a left speaker having a characteristic left directivity that describes a relative volume level output by the left speaker, as a function of azimuth angle, elevation angle, and frequency; a right speaker having a characteristic tight directivity that describes a relative volume level output by the right speaker, as a function of azimuth angle, elevation angle, and frequency, wherein the left directivity and the right directivity operationally produce a volume imbalance or spectral content imbalance between left and right ears of a listener of the left speaker and the right speaker; a processor coupled to the left speaker and the right speaker, the processor configured to: receive an input multi-channel audio signal; perform processing on the input multi-channel audio signal to form an output multi-channel audio signal, the processing including spatial audio processing that operationally causes the plurality of speakers to deliver sound corresponding to a specified left audio channel to a left ear location that corresponds to a left ear of the listener, and operationally causes the plurality of speakers to deliver sound corresponding to a specified right audio channel to a right ear location that corresponds to a right ear of the listener, the processing further including binaural directivity compensation to operationally reduce or eliminate the volume imbalance or spectral content imbalance between the left and right ears of the listener; and direct the output multi-channel audio signal to the left speaker and the right speaker; wherein the left speaker and the right speaker are configured to produce sound corresponding to the output multi-channel audio signal.

In Example 19, the system of Example 18 can optionally be further configured such that the processing further includes spatial audio processing that causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener; the processor is configured to perform the binaural directivity compensation within the spatial audio processing; and the processor is configured to further perform loudspeaker equalization downstream from the spatial audio processing and the binaural directivity compensation.

In Example 20, the system of any one of Examples 18-19 can optionally be further configured such that the processing further includes spatial audio processing that causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener; the processor is configured to perform the binaural directivity compensation downstream from the spatial audio processing; and the processor is configured to further perform loudspeaker equalization downstream from the spatial audio processing, and perform the binaural directivity compensation within the loudspeaker equalization.

What is claimed is:

1. A system for producing binaural directivity-compensated sound, the system comprising:

a plurality of speakers, each of the plurality of speakers having a characteristic directivity that describes a relative volume level output by the speaker, as a function of azimuth angle, elevation angle, and frequency, the directivities of the speakers operationally producing a spectral content imbalance between left and right ears of a listener of the plurality of speakers;

a processor coupled to the plurality of speakers, the processor configured to:

receive an input multi-channel audio signal;

perform processing on the input multi-channel audio signal to form an output multi-channel audio signal, the processing including binaural directivity compensation to operationally reduce or eliminate the spectral content imbalance between the left and right ears of the listener; and direct the output multi-channel audio signal to the plurality of speakers, the plurality of speakers being configured to produce sound corresponding to the output multi-channel audio signal.

2. The system of claim 1, wherein the processing further includes spatial audio processing that:

causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener.

3. The system of claim 2, further comprising a head tracker configured to actively track the left ear location and the right ear location.

4. The system of claim 2, wherein the processor is configured to use estimated and time-invariant left and right ear locations.

5. The system of claim 2, wherein:

the plurality of speakers includes only a left speaker and a right speaker;

the input multi-channel audio signal includes data corresponding to a left input audio signal and a right input audio signal; and the output multi-channel audio signal includes data corresponding to a left output audio signal and a right output audio signal.

6. The system of claim 5, wherein the processor is configured to perform the binaural directivity compensation within the spatial audio processing.

7. The system of claim 6, wherein the processor is configured to perform the spatial audio processing to include cancelling crosstalk between the left speaker and the right ear of the listener and between the right speaker and the left ear of the listener.

8. The system of claim 7, wherein the processor is configured to cancel the crosstalk by:

providing a first directivity value corresponding to a directivity of the left speaker at the left ear location;

providing a second directivity value corresponding to a directivity of the left speaker at the right ear location;

providing a third directivity value corresponding to a directivity of the right speaker at the left ear location;

providing a fourth directivity value corresponding to a directivity of the right speaker at the right ear location;

providing a first head-related transfer function that characterizes how the left ear of the listener, at the left ear location, receives sound from the left speaker;

providing a second head-related transfer function that characterizes how the right ear of the listener, at the right ear location, receives sound from the left speaker;

providing a third head-related transfer function that characterizes how the left ear of the listener, at the left ear location, receives sound from the right speaker;

providing a fourth head-related transfer function that characterizes how the right ear of the listener, at the right ear location, receives sound from the right speaker;

forming a modified second head-related transfer function as the second head-related transfer function, multiplied by the third directivity value, divided by the fourth directivity value;

forming a modified third head-related transfer function as the second head-related transfer function, multiplied by the first directivity value, divided by the second directivity value;

forming a compensation matrix as an inverse of a matrix that includes the first, modified second, modified third, and fourth head-related transfer functions;

forming an input matrix that includes transforms of the left input audio signal and the right input audio signal; and forming an output matrix calculated as a product of the compensation matrix and the input matrix, the output matrix including transforms of the left output audio signal and the right output audio signal.

9. The system of claim 6, wherein the processor is configured to further perform loudspeaker equalization downstream from the spatial audio processing and the binaural directivity compensation.

10. The system of claim 5, wherein the processor is configured to perform the binaural directivity compensation downstream from the spatial audio processing.

11. The system of claim 10, wherein the processor is configured to perform the spatial audio processing to include cancelling crosstalk between the left speaker and the right ear of the listener and between the right speaker and the left ear of the listener.

12. The system of claim 11, wherein the processor is configured to cancel the crosstalk by:

providing a first head-related transfer function that characterizes how the left ear of the listener, at the left ear location, receives sound from the left speaker;

providing a second head-related transfer function that characterizes how the right ear of the listener, at the right ear location, receives sound from the left speaker;

providing a third head-related transfer function that characterizes how the left ear of the listener, at the left ear location, receives sound from the right speaker;

providing a fourth head-related transfer function that characterizes how the right ear of the listener, at the right ear location, receives sound from the right speaker;

forming a compensation matrix as an inverse of a matrix that includes the first, second, third, and fourth head-related transfer functions;

forming an input matrix that includes transforms of the left input audio signal and the right input audio signal; and forming an output matrix calculated as a product of the compensation matrix and the input matrix, the output matrix including transforms of the left output audio signal and the right output audio signal.

13. The system of claim 10, wherein the processor is configured to further perform loudspeaker equalization downstream from the spatial audio processing, and perform the binaural directivity compensation within the loudspeaker equalization.

14. A method for producing binaural directivity-compensated sound, the method comprising:

receiving an input multi-channel audio signal at a processor;

performing, with the processor, processing on the input multi-channel audio signal to form an output multi-channel audio signal, the processing including binaural directivity compensation to compensate for directional variations in performance of each speaker of a plurality of speakers, each of the plurality of speakers having a characteristic directivity that describes a relative volume level output by the speaker, as a function of azimuth angle, elevation angle, and frequency, the directivities of the speakers operationally produce a spectral content imbalance between left and right ears of a listener of the plurality of speakers, the binaural directivity compensation operationally reducing or eliminating the spectral content imbalance between the left and right ears of the listener;

directing the output multi-channel audio signal to the plurality of speakers; and producing sound corresponding to the output multi-channel audio signal with the plurality of speakers.

15. The method of claim 14, wherein the processing further includes spatial audio processing that:

causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener.

16. A system for producing binaural directivity-compensated sound, the system comprising:

a left speaker having a characteristic left directivity that describes a relative volume level output by the left speaker, as a function of azimuth angle, elevation angle, and frequency;

a right speaker having a characteristic right directivity that describes a relative volume level output by the right speaker, as a function of azimuth angle, elevation angle, and frequency, the left directivity and the right directivity operationally producing a spectral content imbalance between left and right ears of a listener of the left speaker and the right speaker; and a processor coupled to the left speaker and the right speaker, the processor configured to:

receive an input multi-channel audio signal;

perform processing on the input multi-channel audio signal to form an output multi-channel audio signal, the processing including spatial audio processing that operationally causes the plurality of speakers to deliver sound corresponding to a specified left audio channel to a left ear location that corresponds to a left ear of the listener, and operationally causes the plurality of speakers to deliver sound corresponding to a specified right audio channel to a right ear location that corresponds to a right ear of the listener, the processing further including binaural directivity compensation to operationally reduce or eliminate the spectral content imbalance between the left and right ears of the listener; and direct the output multi-channel audio signal to the left speaker and the right speaker, the left speaker and the right speaker being configured to produce sound corresponding to the output multi-channel audio signal.

17. The system of claim 16, wherein:

the processing further includes spatial audio processing that causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener;

the processor is configured to perform the binaural directivity compensation within the spatial audio processing; and the processor is configured to further perform loudspeaker equalization downstream from the spatial audio processing and the binaural directivity compensation.

18. The system of claim 16, wherein:

the processing further includes spatial audio processing that causes the plurality of speakers to deliver sound corresponding to a specified left audio channel to a left ear location that corresponds to a left ear of the listener, and causes the plurality of speakers to deliver sound corresponding to a specified right audio channel to a right ear location that corresponds to a right ear of the listener;

the processor is configured to perform the binaural directivity compensation downstream from the spatial audio processing; and the processor is configured to further perform loudspeaker equalization downstream from the spatial audio processing, and perform the binaural directivity compensation within the loudspeaker equalization.

* * * * *